US005190395A

United States Patent [19]

Cathey et al.

[11] Patent Number: 5,190,395

[45] Date of Patent: Mar. 2, 1993

[54] EXPANSION JOINT METHOD AND SYSTEM

[75] Inventors: Joe R. Cathey, Claremore; Dale W. Baker, Owasso, both of Okla.

[73] Assignee: Silicone Specialties, Inc., Tulsa, Okla.

[21] Appl. No.: 835,239

[22] Filed: Feb. 12, 1992

[51] Int. Cl.[5] ..... E01C 11/06; E01C 11/10

[52] U.S. Cl. ..... 404/74; 404/48; 404/64; 404/67; 404/69

[58] Field of Search ..... 404/48-50, 404/51, 67-69, 74; 52/396, 403

[56] References Cited

U.S. PATENT DOCUMENTS

| | | | |
|---|---|---|---|
| 3,538,820 | 11/1970 | Tonjes | 404/74 |
| 3,702,093 | 11/1972 | Van de Loock et al. | 404/62 |
| 4,080,086 | 3/1978 | Watson | 404/69 |
| 4,166,049 | 8/1979 | Huff | 260/2.3 |
| 4,279,533 | 7/1981 | Peterson et al. | 404/68 |
| 4,332,504 | 6/1982 | Arai | 404/68 |
| 4,362,430 | 12/1982 | Ceintrey | 404/68 |
| 4,403,067 | 9/1983 | Uffner | 525/54.5 |
| 4,447,172 | 5/1984 | Galbreath | 404/68 |
| 4,470,719 | 9/1984 | Dziark et al. | 404/75 |
| 4,493,584 | 1/1985 | Guntert | 404/74 |
| 4,516,876 | 5/1985 | Wicks | 404/60 |
| 4,518,741 | 5/1985 | Uffner et al. | 525/54.5 |
| 4,522,531 | 6/1985 | Thomsen et al. | 404/2 |
| 4,537,921 | 8/1985 | Uffner et al. | 524/59 |
| 4,569,968 | 2/1986 | Uffner et al. | 525/54.5 |
| 4,572,702 | 2/1986 | Bone | 404/65 |
| 4,601,604 | 7/1986 | Clark et al. | 404/74 X |
| 4,616,954 | 10/1986 | Taga | 404/74 |
| 4,699,540 | 10/1987 | Gibbon et al. | 404/49 |
| 4,745,155 | 5/1988 | Grossi | 525/54.5 |
| 4,784,516 | 11/1988 | Cox | 404/69 |
| 4,824,283 | 4/1989 | Belangie | 404/64 |
| 4,861,043 | 8/1989 | Anderson et al. | 277/1 |
| 4,871,809 | 10/1989 | Szarka | 525/131 |
| 4,927,291 | 5/1990 | Belangie | 404/64 |
| 4,936,704 | 6/1990 | Killmeyer | 404/74 |
| 4,956,500 | 9/1990 | Vermillion | 525/54.5 |
| 4,963,056 | 10/1990 | Cihal | 404/69 |
| 4,968,178 | 11/1990 | Koster et al. | 404/49 |
| 5,007,765 | 4/1991 | Dietlein et al. | 404/74 |
| 5,088,256 | 2/1992 | Face, Jr. | 404/74 X |

*Primary Examiner*—Stephen J. Novosad
*Attorney, Agent, or Firm*—Head & Johnson

[57] ABSTRACT

A method to produce an expansion joint for adjacent roadway slabs having a gap therebetween. A recess is cut or formed into the surface of each adjacent roadway slab to form a pair of recesses parallel to and adjacent to the gap. The recesses are cleaned to a sound, dust-free and rust-free surface. Each recess is coated with a slightly resilient polymer primer to inhibit rusting and corrosion and to form a bonding surface. A mortar mixture of a slightly resilient polymer and aggregate is installed in each recess to form a pair of parallel nosings adjacent to the gap, the nosings being bonded to the roadway slabs. Opposed surfaces of the nosings are primed with a silicone primer. A temporary backing is inserted in the gap between the nosings. An initially liquid silicone sealant is installed between the nosings and on top of the temporary backing which will cure to form a flexible seal.

10 Claims, 3 Drawing Sheets

EXPANSION JOINT METHOD AND SYSTEM

BACKGROUND OF THE INVENTION

1Field of the Invention

The present invention is directed to an expansion joint system for bridges, roadways, parking structures and the like wherein adjacent roadway slabs are subject to movement yet a flexible seal is required in the gap between adjacent slabs.

2. Prior Art

Roadways, bridges and parking structures are customarily built of sections or slabs arranged with an expansion gap between adjacent slabs. It is known that the slabs will expand and contract in response to temperature changes. In many applications, such as bridges and parking structures, loading due to vehicular traffic also causes vertical movement of the slabs.

Notwithstanding the movement of the slabs, a flexible joint which will retain a water tight seal is highly desirable. A water tight seal will prevent water from getting beneath the slabs and rusting bridges or parking structure components. In freezing conditions, the water will cause damage because of heaving. Additionally, road salts are highly corrosive to bridges. A seal in the expansion joint will also prevent debris from lodging in the joint and causing problems.

Many materials in various arrangements have heretofore been used to seal roadway, bridge and parking structure expansion joints. Some of the materials lose their adhesion and quickly require replacement. In applications with an asphalt overlay, the seal might hold but the asphalt may crumble away.

In new roadway, bridge and parking structure construction, time may not be a critical factor in installation of the joint seal. In remedial applications, however, time is a critical factor so that down time is minimized particularly, where vehicular traffic has to be returned before all of the components have cured.

Various expansion joints have heretofore been proposed. As an example, Gibbon (U.S. Pat. No. 4,699,540) discloses an expansion joint system where a preformed longitudinal resilient tube of heat cured silicone is installed in the recess. An initially flowable adhesive silicone is then injected into the recess on both sides of the tube.

Galbreath (U.S. Pat. No. 4,447,172) discloses a flexible elastomeric membrane wherein adhesive may be utilized to assist in holding the membrane to the side rails.

Cihal (U.S. Pat. No. 4,963,056) provides layers of plastic concrete compound which are cast in the recess. An adhesive coating of an epoxy resin is coated on top of the second layer to assist in retaining a pad which spans the gap.

Belangie (U.S. Pat. No. 4,824,283 and 4,927,291) provides a preformed strip of silicone which floats or is embedded in a silicone adhesive.

Peterson et al. (U.S. Pat. No. 4,279,533) discloses an expansion joint system wherein a metal plate secured to one concrete section bridges the expansion slot. The remainder of the recess is filled with a premolded elastomeric slab surrounded by edge portions which are molded on the job site.

Watson (U.S. Pat. No. 4,080,086) discloses a joint sealing apparatus having a pair of elongated elastomeric pads embedded with crushed rock which are secured to the concrete slabs by studs and nuts. A flexible resilient elongated member extends between the pads.

Accordingly, it is a principal object and purpose of the present invention to provide an expansion joint system for both new construction and remedial applications which may be installed quickly yet is extremely durable.

It is a further object and purpose of the present invention to provide an expansion joint system which combines a capability of adhering to both concrete and steel as well as acting as a primer for adhesion to a silicone sealant.

SUMMARY OF THE INVENTION

An expansion joint system is provided in the present invention to be used for roadways, bridges, parking structures and like. Adjacent roadway slabs are provided with an expansion gap therebetween for thermal expansion and dynamic loading. A recess is provided or is cut into each adjacent roadway section. The base of each recess is parallel to the surface of the roadway. The sidewall of each recess is parallel to the gap between adjacent slabs. The walls and base of the recesses will be cleaned or sandblasted to remove all rust, corrosion and foreign materials.

A temporary form will be installed in the gap between the concrete slabs. The sidewalls and face of each recess are next primed with a slightly resilient polymer primer. After the recesses have been coated with the primer, an additional quantity of the slightly resilient polymer will be combined with an aggregate to form a mortar mixture. A temporary form is inserted in the gap having a top flush with the surface of the roadway. This mixture is then poured into the recesses with enough mortar mixture to fill the recesses to the surface of the road. After the mortar mixture has cured, solid nosings are formed.

The temporary form is removed and the opposed faces of the nosings are sandblasted and then coated with a silicone primer. A preformed backer rod is inserted and wedged in the gap between the nosings to form a shelf. A silicone sealant, initially in liquid form, is then poured or inserted in the gap on top of the backing rod in order to form a water-tight seal.

DETAILED DESCRIPTION OF THE PREFERRED EMBODIMENT

Figure 1:
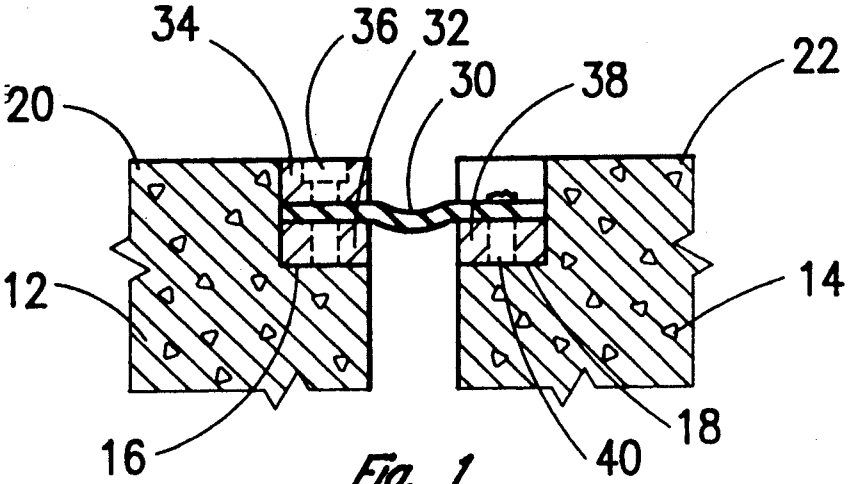
FIGS. 1 through 4 illustrate sectional views showing the installation sequence of an expansion joint system of the present invention in a remedial application having a strip seal joint retained by parallel plates.

Referring to the drawings in detail, FIGS. 1 through 4 illustrate the installation sequence of an expansion joint system 10 of the present invention in a remedial application. The expansion joint system 10 is shown in repair of a failed or damaged strip seal joint on a roadway.

It will be understood that the use of the expansion joint system 10 of the present invention may be used for roadways, bridges, parking structures and the like. In each instance, adjacent roadway slabs are provided with an expansion gap therebetween. A discussion of the use of the expansion joint system in one application will, therefore, be applicable to other uses.

As seen in FIG. 1, a pair of adjacent concrete roadway slabs 12 and 14 are shown in sectional view prior to introduction of the present invention. An expansion gap is provided between the adjacent roadway slabs 12 and 14 to allow for thermal expansion and dynamic movement. A recess 16 and 18, respectively, is provided in each adjacent roadway sections 12 and 14. The base of the recesses 16 and 18 are parallel to the surface of the roadway 20 and 22. The sidewall of the recess is parallel to the gap between the adjacent slabs. An elastomeric strip 30 extends across the gap and provides a seal in the joint. The elastomeric strip 30 is held in place in recess 16 by a lower steel plate 32 and an upper steel plate 34 which is held in place by a bolt 36.

The strip seal 30 is secured to concrete section 14 by a lower steel plate 38, an upper steel plate (which has broken off) and a bolt 40, a part of which is broken off.

In the condition illustrated in FIG. 1, strip seal 30 will eventually fall off and the seal will fail. An additional problem encountered with the strip seal joint is that it is recessed significantly from the surface of the roadway resulting in a rough ride and increase in stress on the joint.

Figure 2:
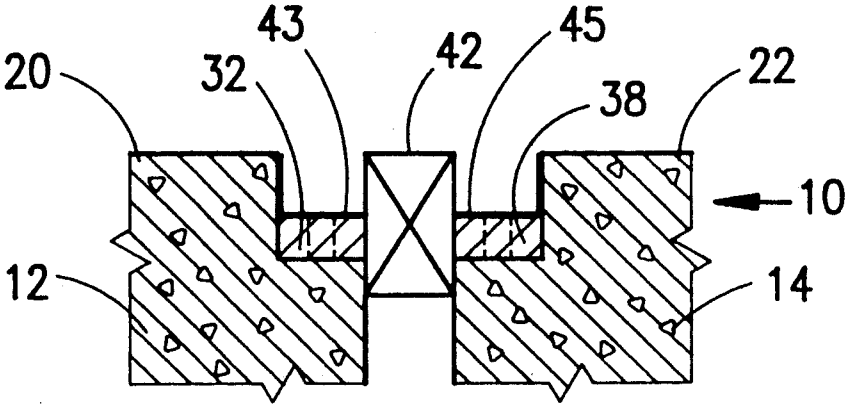

FIG. 2 illustrates the initial installation steps of the expansion joint system. The remaining top plate 34 is removed as well as the strip seal 30 itself. If the lower plates are sound and secure, they may be left in place. If not, the lower plates may be removed as well.

The walls and base of the recesses 16 and 18 must be cleaned, dry, rust-proof and sound. The top surface of the metal plates 32 and 38 will be cleaned or sandblasted to a white metal to remove all rust and corrosion. The walls of the recess will likewise be cleaned or sandblasted.

A temporary form 42 will be installed in the gap between the concrete slabs 12 and 1 flush with the riding surface of the roadway. Styrofoam or other lightweight material that may be compressed slightly will be used for this purpose. The temporary form may also be covered with a layer of tape bond-breaker to facilitate removal of the form.

The sidewalls and face of each recess are next primed with a slightly resilient polymer primer as illustrated by heavy lines 43 and 45. A coal tar liquid epoxy has been found to be desirable for this application. One coal tar liquid epoxy which has been found acceptable for this purpose is manufactured under the name SILSPEC 900 PNS and is a two-component-type coal tar liquid epoxy which adheres to concrete, asphalt and steel. The use of the coal tar epoxy in neat or undiluted form provides an excellent seal for the metal surface to prevent rusting or corrosion.

If the metal surface is allowed to rust, the bond with the nosings may be broken.

Figure 3:
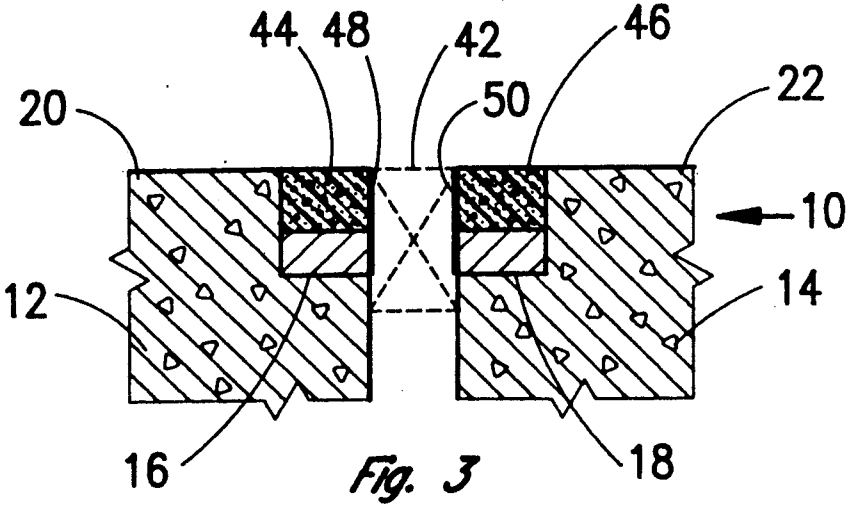

After the recesses have been coated with the epoxy primer, an additional quantity of the slightly resilient polymer will be combined with an aggregate, such as crushed stone or flint, to form a mortar mixture. As best seen in FIG. 3, this mixture is then poured into the recesses 16 and 18 with enough mortar mixture to fill the recesses up to the surface of the road.

After the mortar mixture has cured, solid nosings 44 and 46 are formed. The nosings have excellent adhering quality to the primer in the recesses and are extremely strong and durable. Additionally, the slightly resilient polymer component will absorb some of the impact from traffic. Once the nosings have cured, the temporary form 42 is removed as seen in FIG. 3.

Figure 4:
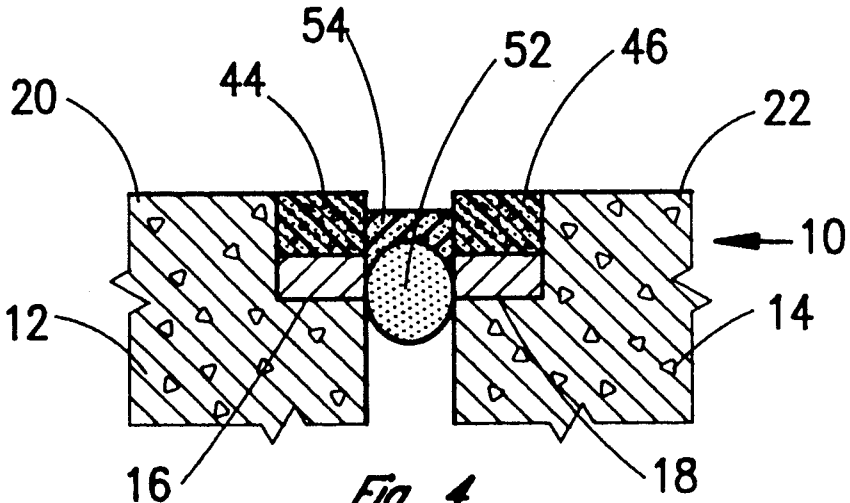
Figure 6:
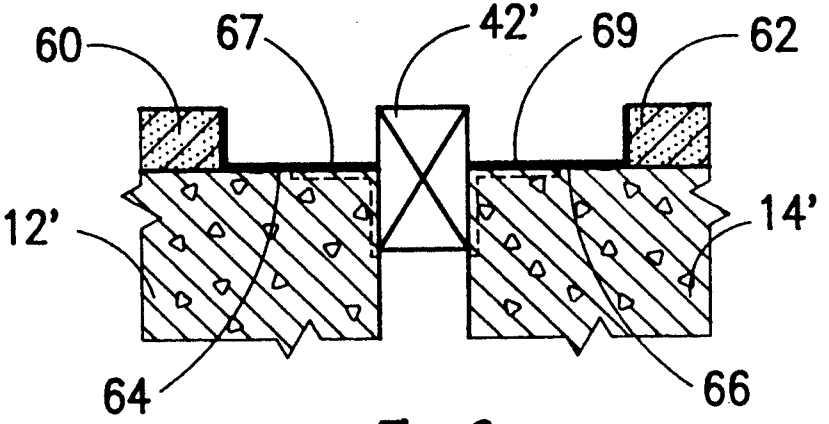
FIGS. 5 through 8 illustrate sectional views showing the installation sequence of an expansion joint system of the present invention in a remedial application having concrete slabs with an asphalt overlay.

After removal of the temporary form, the opposed faces of the nosings are sandblasted and then coated with a silicone primer. The silicone primer is illustrated in FIG. 3 by the heavy dark lines 48 and 50. One silicone primer, which is acceptable for this purpose, is manufactured under the name DOW CORNING 1205 primer. Once the primer 48 and 50 has dried, a preformed backer rod 52 is inserted and wedged in the gap between the nosings. The backing rod 52 may be cylindrical and composed of a closed cell polyethylene rubber or other similar materials. The backing rod is used solely as a shelf to receive the silicone sealant and is thereafter unimportant in the expansion joint system. A silicone sealant 54 which is initially in liquid form is poured or inserted in the gap on top of the backing rod as best seen in FIG. 4.

A one-part silicone such as DOW CORNING 890 SL or a two-part rapid-cure self-levelling silicone such as DOW CORNING 002 RCS has proved acceptable for this purpose. A two-part silicone is preferred in remedial applications because it cures quicker resulting in less down time.

FIGS. 5 through 8 illustrate the use of the present expansion joint system to provide an expansion joint for concrete slabs 12' and 14', which have been overlaid with an asphalt overlay 60 and 62.

Figure 5:
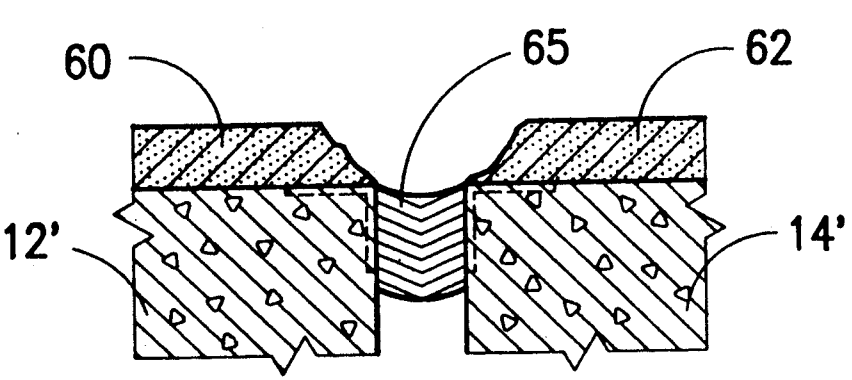

FIG. 5 illustrates a sectional view of the adjacent slabs 12' and 14' wherein the asphalt overlay 60 and 62 is crumbling away due to traffic, weather conditions or movement.

The existing joint seal 65 will be removed to start installation of the present joint system. The asphalt overlay is saw cut parallel with the gap and a minimum of six inches back from the gap to form recesses 64 and 66. The saw cut will be deep enough to reach the concrete deck beneath the asphalt overlay. Surfaces of the recesses 64 and 66 must be sandblasted, dry, clean and sound.

A temporary form 42' is inserted in the gap between the concrete slabs 12' and 14' flush with the roadway surface. The sidewalls and base of the recess are then coated with an epoxy primer in undiluted or neat form. The epoxy primer is illustrated by the heavy dark lines 67 and 69 in FIG. 6.

Figure 7:
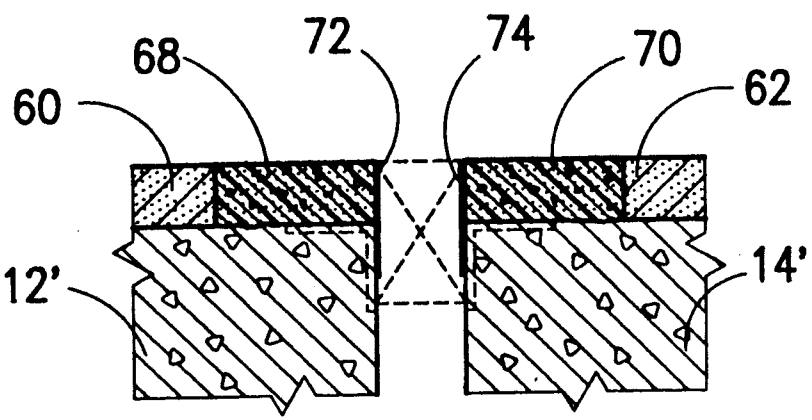

Thereafter, an additional quantity of epoxy will be combined with an aggregate to form a mortar mixture which will be poured to form nosings 68 and 70, as best seen in FIG. 7.

After curing of the nosings 68 and 70, the temporary form 42' (shown by dashed lines in FIG. 7), is removed. The opposed faces of the nosings 68 and 70 are sandblasted and then coated with a silicone primer (shown by heavy dark lines 72 and 74).

Figure 8:
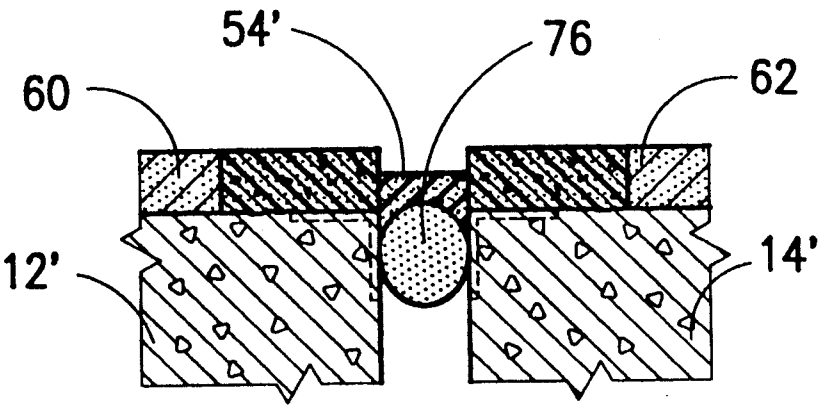

As shown in FIG. 8, a preformed backing rod 76 is wedged in the gap between the nosings. A silicone sealant 54' is poured in the gap on top of the backing rod as best seen in FIG. 8.

Figure 10:
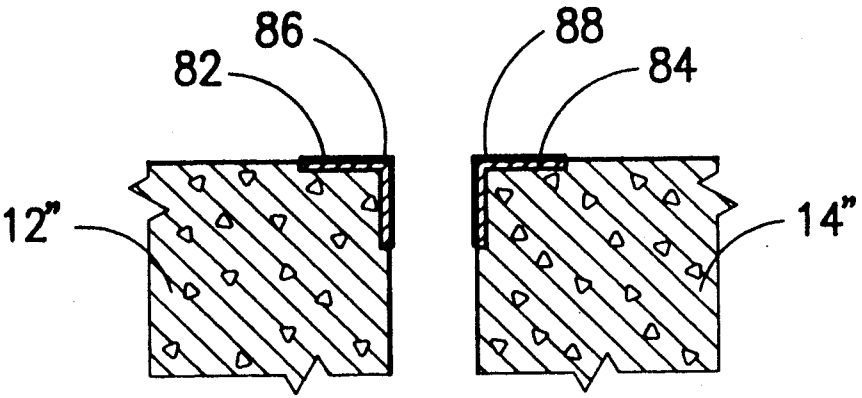
FIGS. 9 through 11 illustrate sectional views showing the installation sequence of an expansion joint system of the present invention in a remedial application having metal plate nosings with a flexible compression seal.
Figure 9:
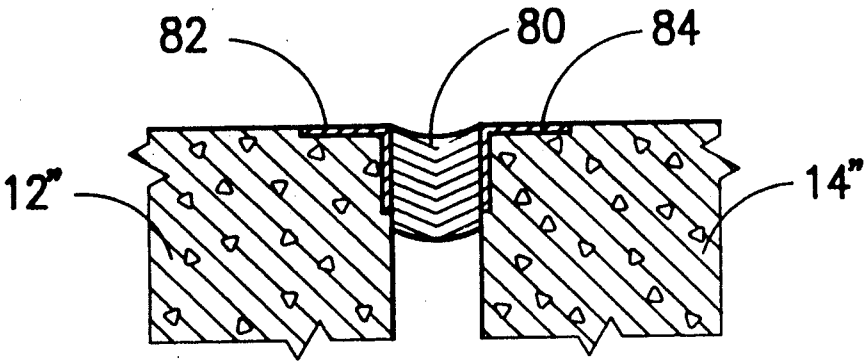
Figure 11:
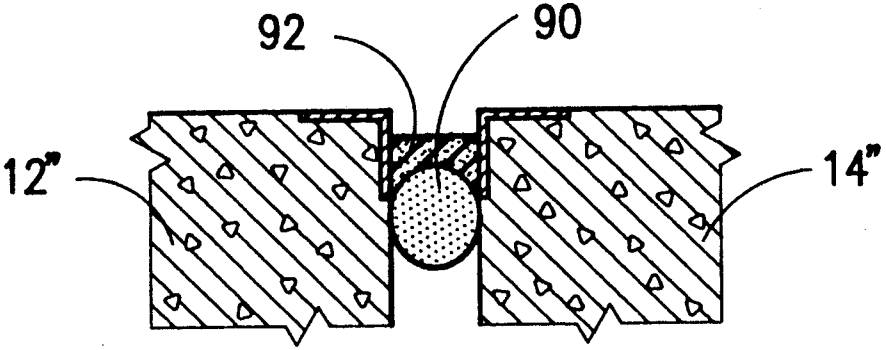

FIGS. 9 through 11 illustrate the use of the present invention with concrete slabs 12'' and 14'' having existing steel nosings affixed to the corners adjacent the expansion gap. The existing seal 80, shown in FIG. 9, will be removed before installation of the present system. Although recesses may be cut into the roadway as previously described, an alternate procedure may be employed.

The steel nosings 82 and 84 will be sandblasted to white metal and then coated with epoxy primer 86 and 88 (shown by heavy lines as seen in FIG. 10) and allowed to cure.

The opposed faces of the steel nosings 82 and 84 are thereafter coated with a silicone primer and allowed to dry. Thereafter, a backing rod 90 is wedged between the concrete slabs to act as a shelf.

Finally, a silicone sealant 92 is poured in the gap on top of the backing rod 90 to form a water tight seal.

Whereas, the present invention has been described in relation to the drawings attached hereto, it should be understood that other and further modifications, apart from those shown or suggested herein, may be made within the spirit and scope of this invention.

What is claimed is:

1. A method to produce an expansion joint for adjacent roadway slabs having a gap therebetween, which comprises:

a. cutting or forming a recess into the surface of each of said adjacent roadway slabs to form a pair of recesses parallel to and adjacent said gap;

b. cleaning said recesses to a sound and rust-free surface;

c. coating each recess with a slightly resilient polymer primer to inhibit rust and corrosion and to form a bonding surface;

d. installing a mortar mixture of said slightly resilient polymer and aggregate into each recess to form a pair of parallel nosings adjacent to said gap, said nosings bonded to said roadway slabs;

e. sandblasting and then priming opposed surfaces of said nosings with a silicone primer;

f. inserting a temporary backing between said nosings in said gap;

g. installing an initially liquid silicone sealant between said nosings and on top of said temporary backing which will cure to form a flexible seal.

2. A method to produce an expansion joint for adjacent roadway slabs as set forth in claim 1 wherein said slightly resilient polymer primer and said slightly resilient polymer for said mortar mixture are liquid, coal tar based epoxy and compatible with silicone.

3. A method to produce an expansion joint for adjacent roadway slabs as set forth in claim 1 wherein said aggregate is crushed stone or flint.

4. A method to produce an expansion joint for adjacent roadway slabs as set forth in claim 1 wherein said silicone sealant is a two-part sealant curing by reaction with moisture in the air.

5. A method to produce an expansion joint for adjacent roadway slabs as set forth in claim 1 including installing a form spanning said gap before installation of said mortar mixture wherein said form is removed after said mortar has cured.

6. A roadway expansion joint system for adjacent roadway slabs having a gap therebetween, which system comprises:

a. epoxy primer to coat and adhere to a recess cut or formed into the surface of each of said adjacent roadway slabs forming a pair of recesses parallel to and adjacent said gap;

b. a nosing to fill each of said recesses, said nosings formed of a mortar mixture of epoxy and aggregate which will bond with and adhere to said epoxy primer;

c. silicone primer to coat opposed surfaces of said nosings;

d. a temporary backing inserted between said nosings in said gap; and e. an initially flowable silicone sealant between said nosings and on top of said temporary backing which will cure to form a flexible seal.

7. A roadway expansion joint system as set forth in claim 6 wherein said epoxy primer and said epoxy in said mortar mixture is a coal tar based liquid epoxy compatible with silicone.

8. A roadway expansion joint system as set forth in claim 6 wherein the base of each recess is parallel with said roadway surface and each of said recesses is at least six inches in width.

9. A roadway expansion joint system as set forth in claim 6 including a form spanning said gap which is inserted in said gap flush with the surface of said roadway before installation of said mortar mixture wherein said form is removed after said mortar has cured.

10. A method to produce an expansion joint for adjacent roadway slabs having a gap therebetween and opposed to metal nosings adjacent said gap, which method comprises:

a. cleaning said opposed metal nosings to a sound, rust-free and dust-free surface;

b. coating each said metal nosing with a slightly resilient polymer primer to inhibit rust and corrosion and to form a bonding surface;

c. coating opposed surfaces of said metal nosings with a silicone primer;

d. inserting a temporary backing between said metal nosings in said gap; and e. installing an initially liquid silicone sealant between said nosings and on top of said temporary backing which will cure to form a flexible seal.

* * * * *